US005119050A

United States Patent [19]

Upshur et al.

[11] Patent Number: 5,119,050

[45] Date of Patent: Jun. 2, 1992

[54] LOW LOSS 360 DEGREE X-BAND ANALOG PHASE SHIFTER

[76] Inventors: John I. Upshur, 13528 Spinning Wheel Dr., Germantown, Md. 20874; Bernard D. Geller, 11102 Whisperwood La., Rockville, Md. 20852

[21] Appl. No.: 514,805

[22] Filed: Apr. 26, 1990

[51] Int. Cl.[5] ..... H01P 1/185

[52] U.S. Cl. ..... 333/164; 333/117; 333/161

[58] Field of Search ..... 333/109, 117, 118, 112, 333/116, 156, 161, 164, 139

[56] References Cited

U.S. PATENT DOCUMENTS

| | | | |
|---|---|---|---|
| 4,288,763 | 9/1981 | Hopfer | 333/117 X |
| 4,638,269 | 1/1987 | Dawson et al. | 333/164 |
| 4,837,532 | 6/1989 | Lang | 333/164 |
| 4,859,972 | 8/1989 | Franke et al. | 333/164 |

OTHER PUBLICATIONS

"Linear Analog Hyperabrupt Varactor Diode Phase Shifters", Niehenke et al., 1985 IEEE MTT-S Digest, pp. 657-660.

"360° Varactor Linear Phase Modulator", Garver, IEEE Transactions on Microwave Theory and Techniques, vol. MTT-17, No. 3, Mar. 1969, pp. 137-147.

*Primary Examiner*—Eugene R. LaRoche
*Assistant Examiner*—Seung Ham

[57] ABSTRACT

A low loss reflection-type analog phase shifter circuit producing a large range (nearly 360°) of phase shift at X-band while achieving low attenuation (insertion loss) and little amplitude variation over all phase states. The results are achieved, in part, by using a terminating impedance which includes parallel-connected hyperabrupt varactor diodes. The circuit is implemented readily in a monolithic microwave integrated circuit using GaAs.

17 Claims, 6 Drawing Sheets

FIG. 1
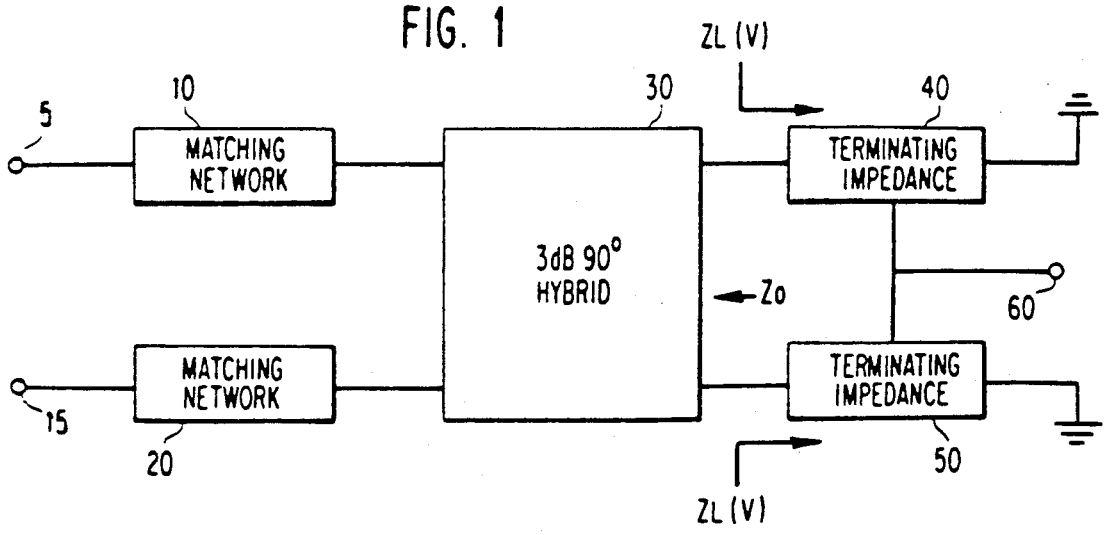
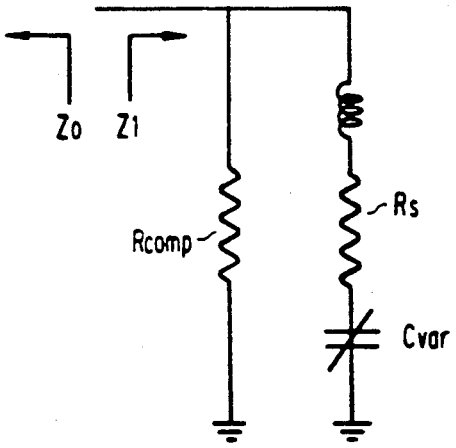
FIG. 2a
FIG. 2b
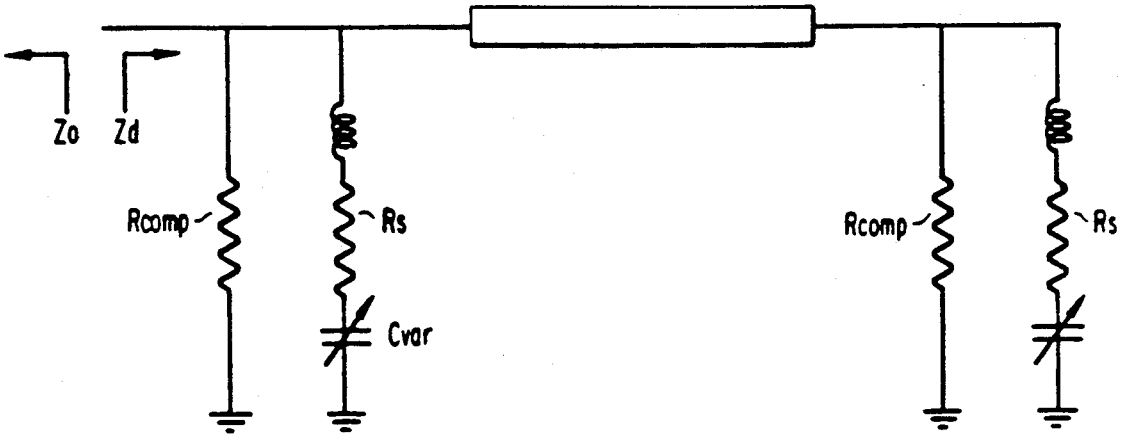

LOW LOSS 360 DEGREE X-BAND ANALOG PHASE SHIFTER

BACKGROUND OF THE INVENTION

The present invention relates to a low loss reflection-type analog phase shifter circuit producing nearly 360° of phase shift at X-band. The inventive circuit experiences low insertion loss variation with phase. The circuit is implementable readily in a monolithic microwave integrated circuit (MMIC) using GaAs.

Analog phase shifters are well-known, as disclosed for example in U.S. Pat. No. 4,837,532 and 4,638,629. Such phase shifters using hyperabrupt varactor diodes also are known, as set forth in the paper by Niehenke et al., *Linear Analog Hyerabrupt Varactor Diode Phase Shifters,* 1985 IEEE MTT-S Digest, pp. 657–660. Such is also known from U.S. Pat. No. 4,638,269.

However, while such phase shifters are known, the results of these phase shifters at X-band have not demonstrated a full 360° phase shift, and small insertion loss variation with phase. For example, the above-referenced paper discloses results of about 270° of phase shift, and a total insertion loss modulation of 1.7 dB. The just-mentioned U.S. patent improving on results disclosed in a paper (Dawson et al.), *An Analog X-Band Phase Shifter.* IEEE 1984 Microwave and Millimeter-Wave Monolithic Circuits Symposium, Digest of Papers, pp. 6–10, shows about 180° of phase shift, using serially-connected varactors for increasing phase shifter power handling capability. The paper itself showed only 105° of phase shift, but the patent stated that the relatively poor results were due to limitations of tuning capacitance across the varactor diode pair in the fabricated chip.

Another paper, by Garver, 360° *Varactor Linear Phase Modulator,* IEEE Transactions on Microwave Theory and Techniques, Vol. MTT-17, No. 3, March 1969, pp. 137–147, discloses the provision of 360° modulation by combining two varactor diodes each providing 180° modulation, in parallel. However, the parallel-coupled varactors are connected to a circulator, and not to a hybrid coupler. Further, the characteristic impedance of the Garver system is higher (50Ω) than that contemplated by the invention.

SUMMARY OF THE INVENTION

In view of the foregoing it is an object of the present invention to provide a low loss analog phase shifter with substantially 360° of phase shift.

It is another object of the invention to provide a low loss reflection-type phase shifter.

It is yet another object of the invention to provide a low loss reflection-type analog phase shifter, having substantially 360° of phase shift with low insertion loss variation across all phase states, which is readily implementable in MMIC form using GaAs.

To achieve the foregoing and other objects, the inventive analog phase shifter includes a hybrid coupler, and a terminating impedance which employs a pair of parallel-connected hyperabrupt varactor diodes separated by a quarter-wavelength transmission line having a characteristic impedance substantially twice that of the hybrid coupler. By using the parallel-connected varactors, phase shift range is doubled compared to that achieved with a single diode termination. Thus, requirements on varactor tuning ratio are less stringent. Thus, it is possible to avoid the tuning capacitance difficulties identified in U.S. Pat. No. 4,638,269.

Also, by providing a characteristic impedance of the hybrid coupler of less than 50Ω, the available phase shift range may be extended for a given diode capacitance range. The invention uses matching networks at the input and output ports of the hybrid coupler to transform the 50Ω level of the rest of the system to the appropriate characteristic impedance level which in a preferred embodiment is 30Ω.

The just-discussed structure provides 180° of phase shift. Providing a second hybrid coupler in cascade, with corresponding terminating impedance circuitry, doubles the phase shift range to 360°.

BRIEF DESCRIPTION OF THE DRAWINGS

The foregoing and other objects and features of the invention will be understood more readily through the detailed description provided below with reference to the accompanying figures, in which:

FIG. 1 shows a basic schematic of a reflection-type phase shifter;

FIGS. 2*a* and 2*b* show single and dual varactor terminating impedances for use in the reflection-type analog phase shifter of the invention;

DETAILED DESCRIPTION OF THE PREFERRED EMBODIMENT

Figure 3:
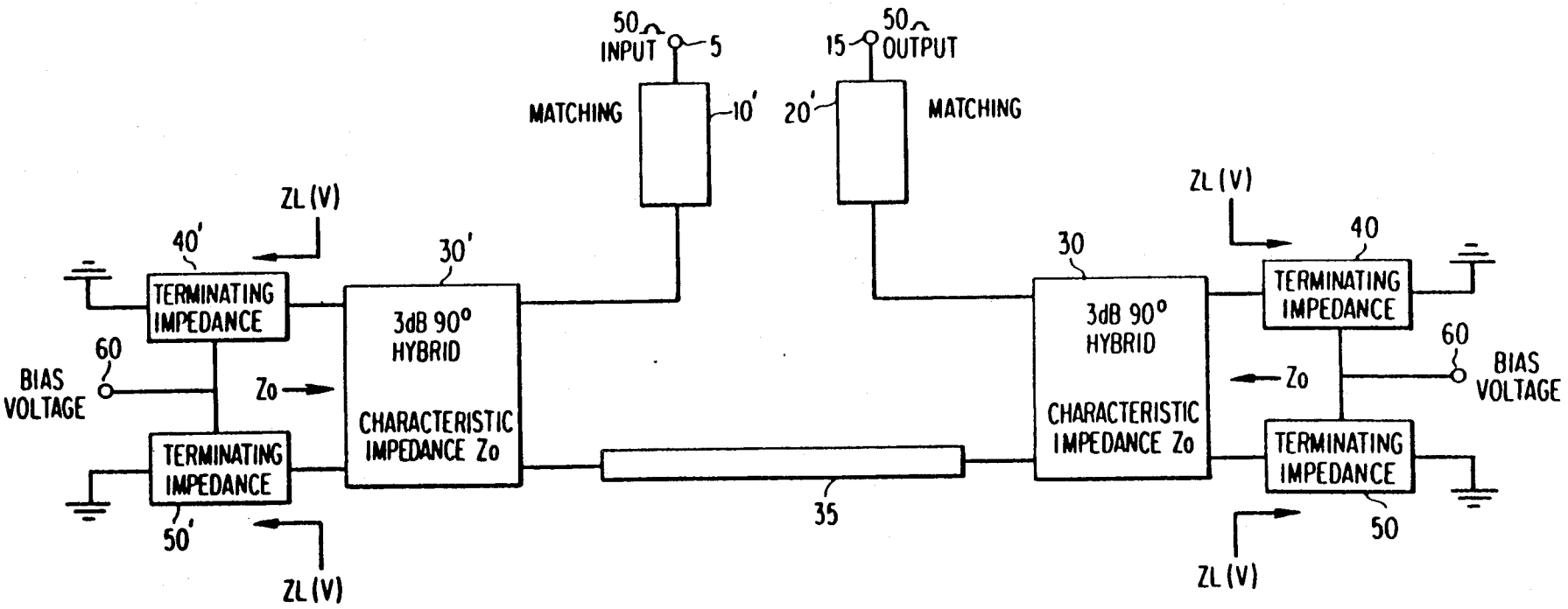
FIG. 3 shows a low loss analog phase shifter schematic employing two hybrid couplers connected in cascade, with respective pairs of terminating impedance circuits.

The inventive circuit is based on the well known reflection phase shifter, in which the through and coupled ports of a 90° hybrid are terminated in low loss reactive networks The other two ports of the hybrid form the circuit input and output. The preferred embodiment of the invention employs Lange couplers to realize the 90° hybrids, and hyperabrupt varactor diode circuits for the terminating impedances. The desirability of using hyperabrupt varactor diodes derives from the ability to control the hyperabrupt active layer of the varactor to achieve a C/V characteristic which enables large phase shifts with approximately linear phase versus voltage behavior FIG. 1 shows a basic schematic of the reflection-type phase shifter of the invention. 50Ω input and output ports 5, 15 terminate in matching impedance networks 10, 20 which impedance match the 50Ω input and outputs to the characteristic impedance $Z_0$ of the 3 dB 90° hybrid 30. In a preferred embodiment of the invention, $Z_0$ is substantially 30Ω. Terminating impedances 40, 50 are shown at the through and coupled ports of the hybrid. A bias voltage is applied at terminal 60 to each of the terminating impedances FIG. 2*a* shows one example of a terminating impedance employing a single varactor which is shown schematically therein. The resistance $R_{comp}$ is provided solely to compensate for the variation of phase shifter insertion loss as bias to the varactor is changed. The resistor helps to make the insertion loss constant over all phase states.

FIG. 2*b* shows a preferred embodiment of the terminating impedance circuit, employing parallel-connected varactors, each with the above-mentioned compensating resistance $R_{comp}$. The two varactors are separated by a quarter-wavelength transmission line with a characteristic impedance substantially twice that of the hybrid coupler in FIG. 1 (i.e. 60Ω).

FIG. 3 is a schematic of the invention with hybrid couplers 30, 30' connected in cascade. An input port of the coupler 30 is connected to the input of the overall circuit through a matching impedance network 10'. The output port of the coupler 30' is connected to the input port of the coupler 30 through a transmission line 35; in a preferred embodiment, the transmission line 35 has an impedance of 30Ω. The output port of the coupler 30 is connected to the overall output of the circuit through a matching impedance network 20'. The coupled and through ports of the coupler 30' are connected to terminating impedance circuits 40', 50', and the coupled and through ports of the coupler 30 are connected to terminating impedance circuits 40, 50. The total phase shift provided by the circuit of FIG. 3 is 360°, or twice that of the circuit of FIG. 1.

Figure 4:
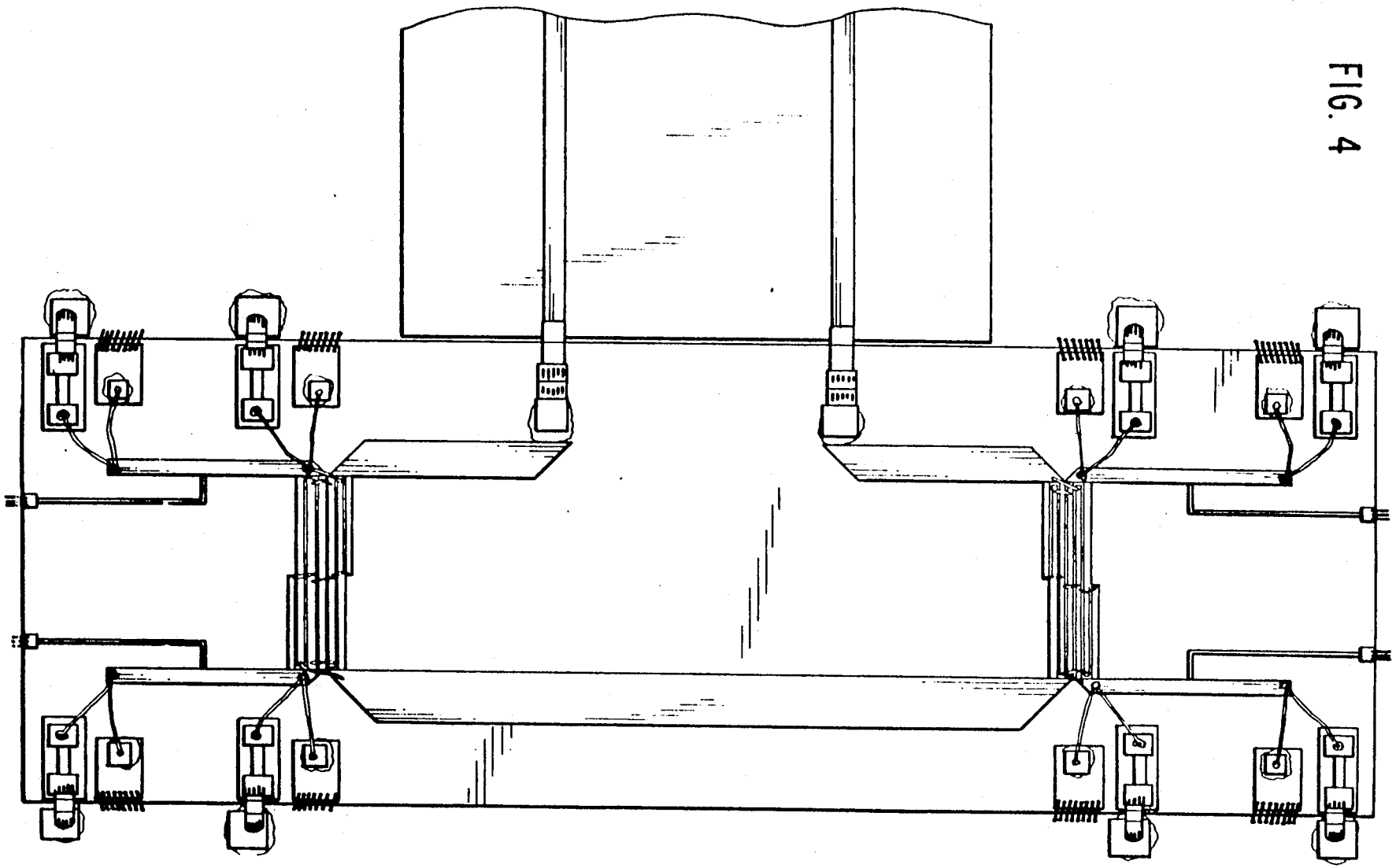
FIG. 4 shows an actual implementation of the inventive circuit.

FIG. 4 shows an actual implementation of the circuit. The cascaded 180° phase shift sections are apparent. Also, Lange couplers are used as the hybrid couplers 30, 30'.

Looking a little more closely at FIG. 1, the energy incident at the output port is divided equally between the coupled and through ports of the hybrid, and is reflected from the respective varactor networks. The reflected signal undergoes a phase change determined in accordance with the reflection coefficient of the terminating impedance. The overall energy then is recombined at the isolated port of the hybrid, which forms the circuit output. The reflection coefficient is a function of the impedance level $Z_0$ of the hybrid coupler and the phase range determined by the maximum capacitance variation of the varactor(s). The total phase range determines the amount of phase shift available from the circuit.

For real varactors with finite Q, the effective series resistance also must be included in the circuit model. The effect of series resistance dominates the overall insertion loss of the phase shifter circuit, and also determines the variation of insertion loss with applied voltage. The use of the shunt resistor $R_{comp}$ in parallel with the varactor is known, as seen for example in the above-mentioned Garver article. The effect of the shunt resistor on the available phase shift range is negligible.

For a given varactor capacitance range, the available amount of phase shift may be increased by lowering the impedance level $Z_0$ below 50Ω. The preferred impedance in the present invention is 30Ω. This is found, for this design, to be the optimum impedance level to produce the necessary phase shift range, considering bandwidth requirements and the capacitance range available from the diode. For a single diode termination, this impedance will provide a 90° phase shift range, which may be doubled by using a dual varactor terminating impedance, as shown in FIG. 2*b* , and as known from the Garver article mentioned above, though the Garver article presents this structure in a different context from the invention.

The reflection phase shifter circuit constructed with the type of termination shown in FIG. 2*b* gives 180° of phase shift for a capacitance variation of between 0.2 pf and 2 pf. To achieve the full 360° range, then, two identical 180° circuits are placed in cascade, as shown in FIG. 3.

FIG. 4 shows the circuit implementation on a 10 mil thick alumina substrate, with bond wires to interconnect the fingers of each Lange coupler, and to connect between the circuit and varactor and resistor chip components The total capacitance variation for a typical diode was measured to be 2.3 pf to 0.25 pf.

Figure 5A:
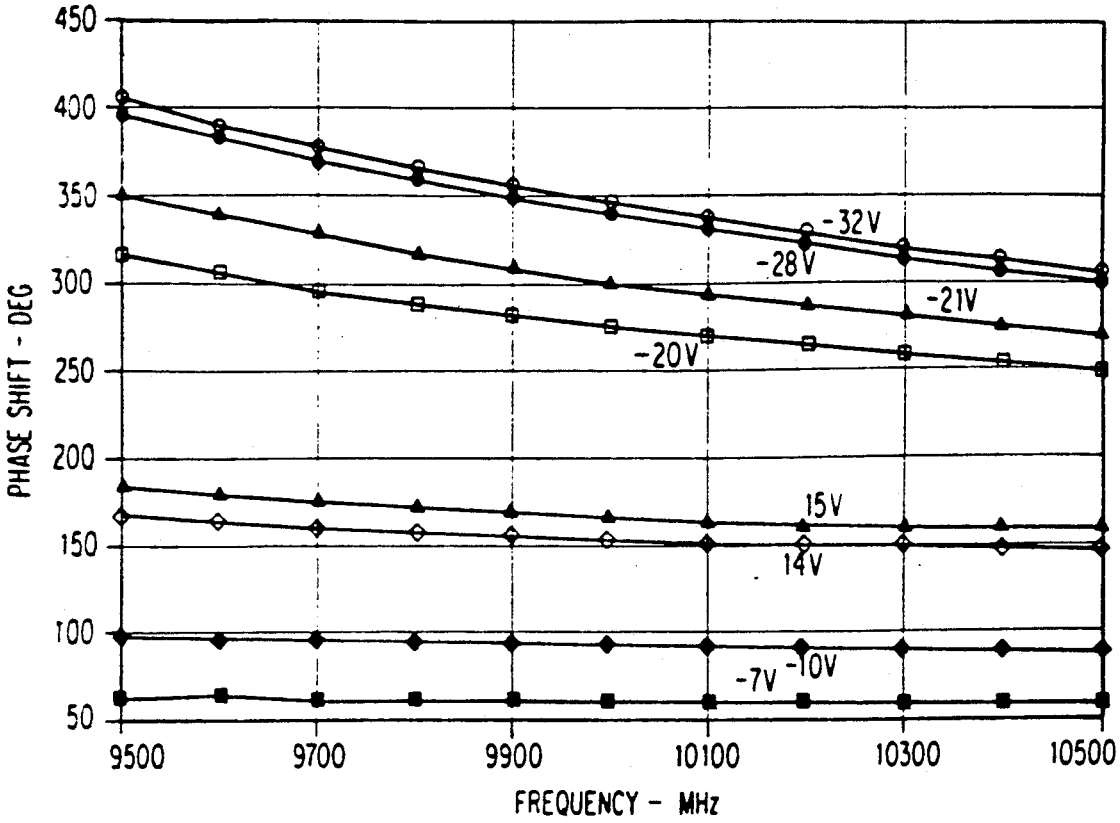
FIGS. 5*a* and 5*b* show relative phase shift and insertion loss for the inventive phase shifter.
Figure 5B:
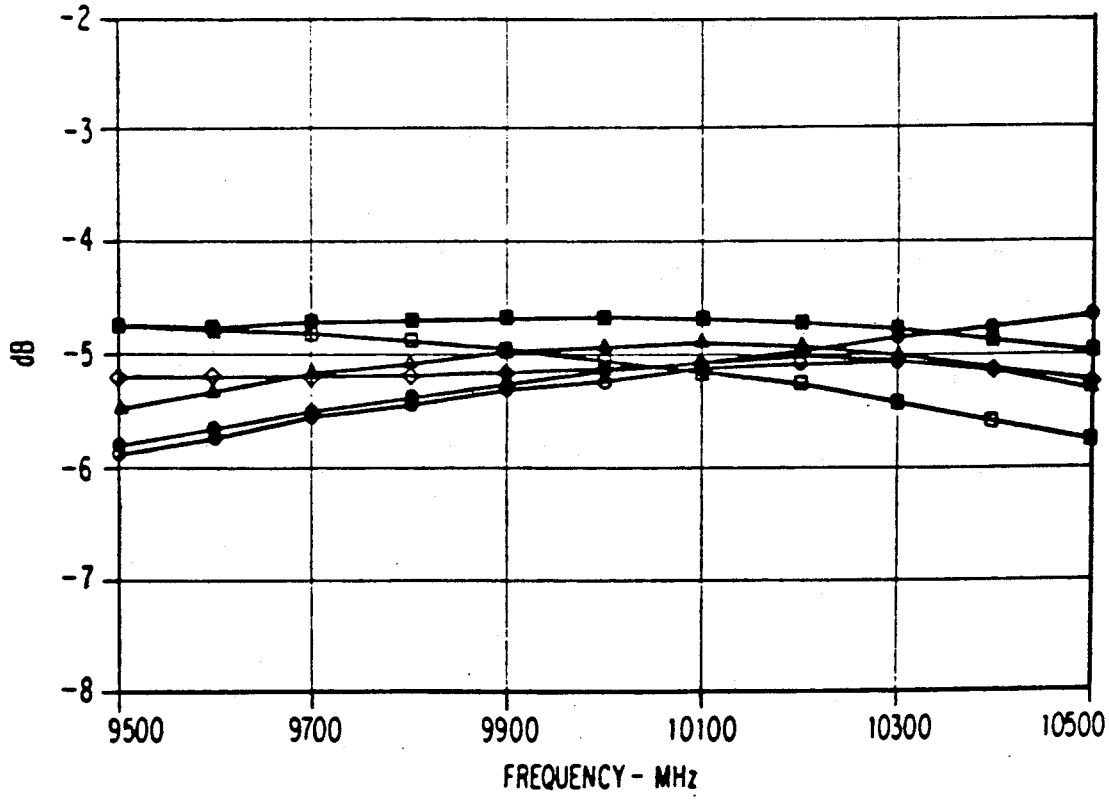
Figure 5C:
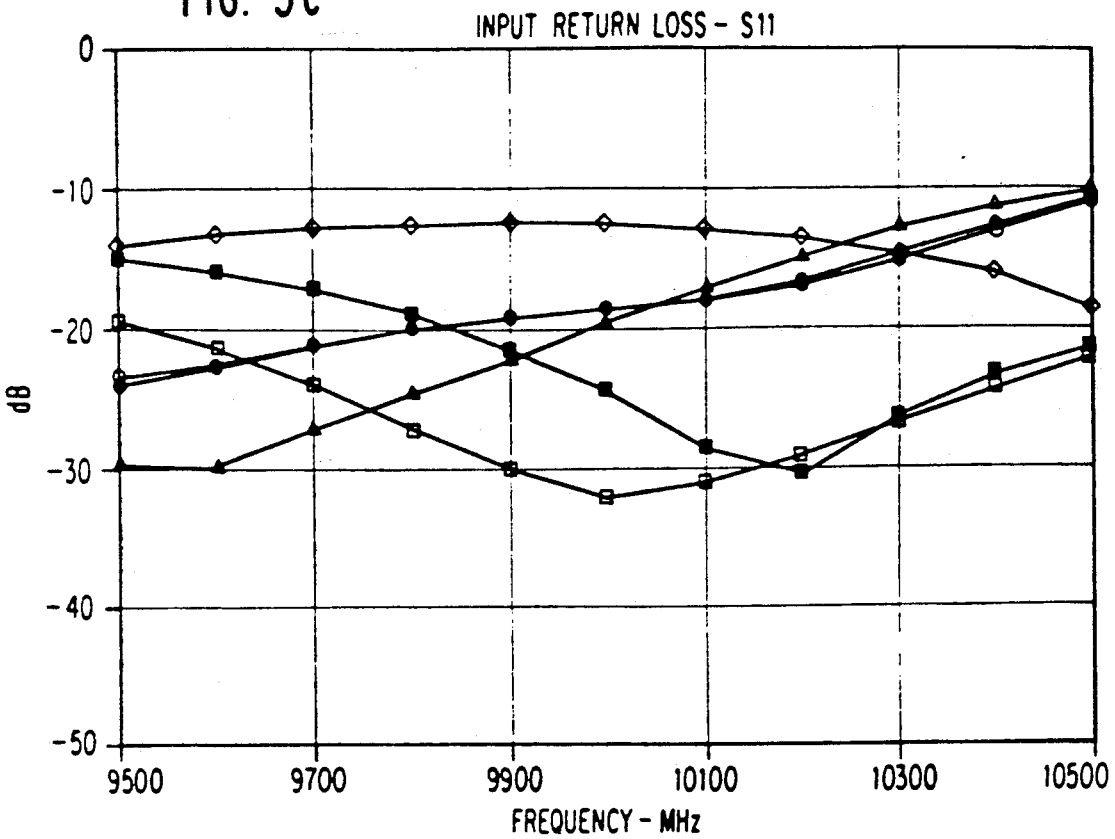
FIGS. 5*c* and 5*d* show input and output return loss, respectively, for the inventive circuit.
Figure 5D:
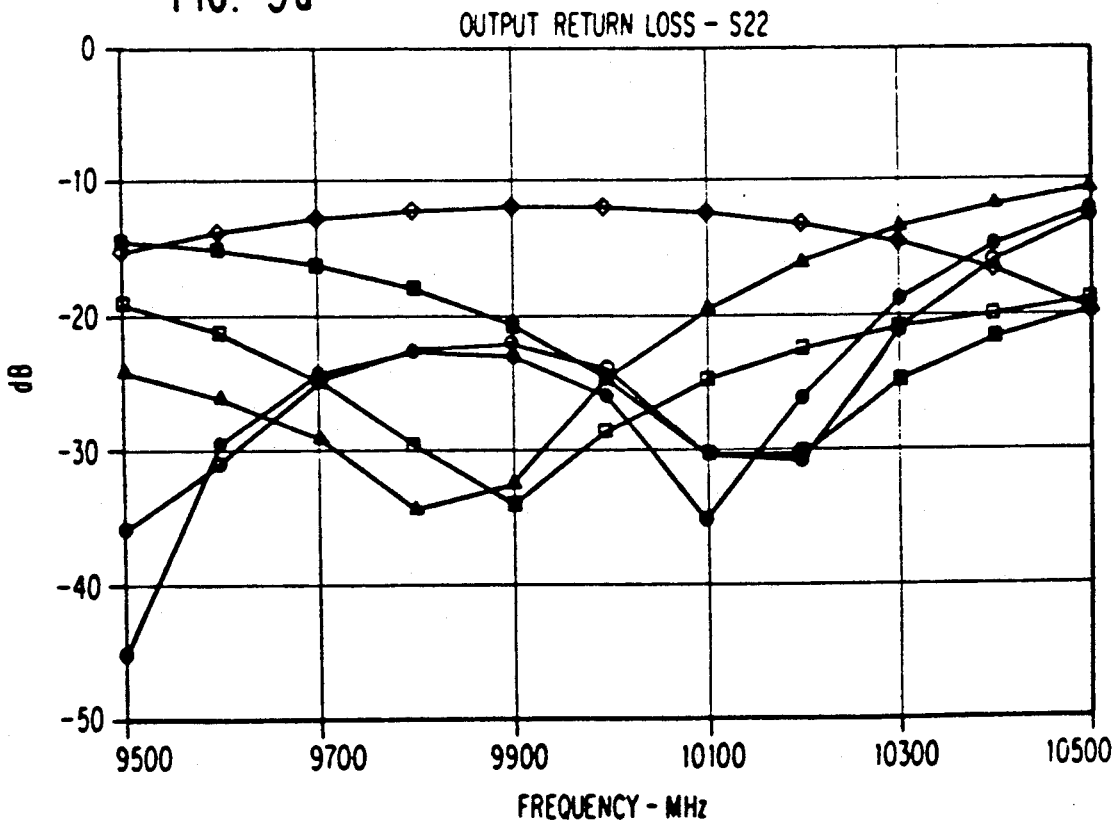

The measured results over 9.5–10.5 GHz are summarized in FIGS. 5*a* -5*d*. The relative phase shift plots in FIG. 5*a* use the zero bias state as the 0° reference for all other bias states. The phase shift range could be extended by using diodes with a lower $C_{min}$ value. The insertion loss plot in FIG. 5*b* shows an average absolute value of about 5.3 dB. which includes approximately 0.5 dB of test fixture loss. The insertion loss modulation over this frequency band is within ±0.5 dB. The input and output return losses shown in FIGS. 5*c* and 5*d* are similar because of the symmetrical design of the circuit.

Figure 6:
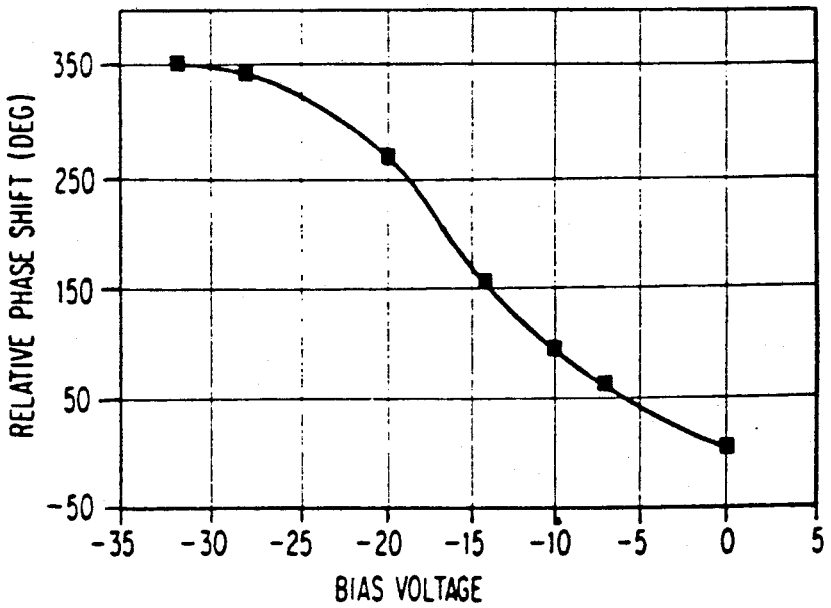
FIG. 6 is a graph of measured phase versus voltage characteristics at 10 GHz.

FIG. 6 shows the phase versus voltage characteristics of the inventive circuit at 10 GHz. The curve shows approximately linear behavior until $C_{min}$ is approached at approximately −25 V bias.

Figure 7:
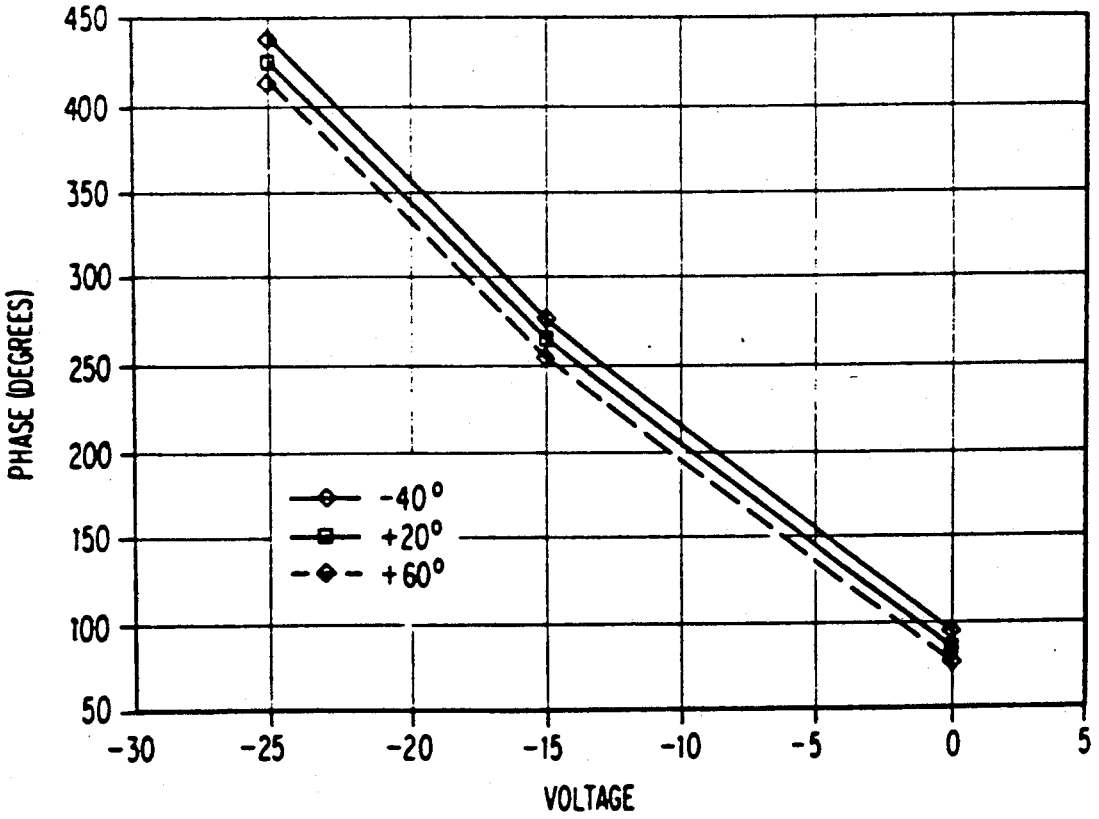
FIG. 7 shows a graph of temperature dependence of phase shift in the inventive analog phase shifter.

The effect of temperature on phase shifter performance is summarized in FIG. 7, where phase shift is displayed with temperature and bias voltage as parameters. Phase shift results are shown for the bias states 0 V, −5 V, −25 V and temperatures of −40° C., 20° C., and +60° C. As can be seen, the temperature change produces nearly the same incremental phase shift for all bias states, and therefore the relative phase shift from one bias state to the next is affected very little by changes in temperature.

The circuit described here is operated with the varactors in a reverse bias state and consequently the DC power requirements are negligible. Only a single bias voltage is required for all eight varactors in the circuit so that very simple control circuitry may be used. Unlike digital phase shifter approaches the available phase resolution depends primarily on the number of bits in the D/A converter. Therefore, higher levels of resolution do not result in significant increases in circuit complexity or insertion loss.

The design described here may be implemented readily in MMIC using monolithic hyperabrupt varactor technology. The monolithic circuit will avoid many of the parasitics and nonuniformities inherent in the microwave integrated circuit implementation shown in FIG. 4. Monolithic varactors have lower series resistance than commercial diodes of similar capacitance range, resulting in an even lower insertion loss. Also, the bias voltage range for monolithic varactors is 0–10 V, considerably less than the bias requirements for commercial devices.

While the invention has been described in detail above with reference to a preferred embodiment, various modifications within the scope and spirit of the invention will be apparent to people of working skill in this technological field. Thus, the invention should be considered as limited only by the scope of the appended claims.

What is claimed is:

1. An analog phase shifter comprising:

a first hybrid coupler having an input port, an output port, and first and second phase shifting ports, said first hybrid coupler having a characteristic impedance $Z_0$; and a first pair of terminating impedance circuit means, connected respectively to said first and second phase shifting ports of said first hybrid coupler, each of said terminating impedance circuit means comprising in turn a pair of hyperabrupt varactor diodes, connected in parallel with a quarter-wavelength transmission line therebetween having a characteristic impedance $2Z_0$.

2. An analog phase shifter as claimed in claim 1, further comprising:

a second hybrid coupler having an input port and an output port, and first and second phase shifting ports, said second hybrid coupler having a characteristic impedance $Z_0$; and a second pair of terminating impedance circuit means, connected respectively to said first and second phase shifting ports of said second hybrid coupler, each of said second pair of terminating impedance circuit means comprising in turn a pair of hyperabrupt varactor diodes, connected in parallel with a quarter-wavelength transmission line therebetween having a characteristic impedance $2Z_0$, wherein said input port of said first hybrid coupler is connected to an input of said analog phase shifter; said output port of said first hybrid coupler is connected to said input port of said second hybrid coupler; and said output port of said second hybrid coupler is connected to an output of said analog phase shifter.

3. An analog phase shifter as claimed in claim 1, further comprising first and second impedance matching networks, connected respectively to said input and output ports of said first hybrid coupler, for impedance matching an input impedance to said analog phase shifter with said characteristic impedance of said first hybrid coupler.

4. An analog phase shifter as claimed in claim 2, further comprising first and second impedance matching networks, connected respectively to said input port of said first hybrid coupler and said output port of said second hybrid coupler, for impedance matching an input impedance to said analog phase shifter with said characteristic impedance of said first and second hybrid couplers.

5. An analog phase shifter as claimed in claim 3, wherein an impedance of each of said impedance matching networks is substantially 50Ω.

6. An analog phase shifter as claimed in claim 4, wherein an impedance of each of said impedance matching networks is substantially 50Ω.

7. An analog phase shifter as claimed in claim 1, further comprising bias voltage means, connected to each of said terminating impedance circuit means, for applying a bias voltage thereto.

8. An analog phase shifter as claimed in claim 2, further comprising bias voltage means, connected to each of said terminating impedance circuit means, for applying a bias voltage thereto.

9. An analog phase shifter as claimed in claim 1, wherein said first hybrid coupler comprises a Lange coupler.

10. An analog phase shifter as claimed in claim 2, wherein said first and second hybrid couplers comprise Lange couplers.

11. An analog phase shifter as claimed in claim 1, wherein $Z_0$ is less than 50Ω.

12. An analog phase shifter as claimed in claim 1, wherein $Z_0$ is substantially 30Ω.

13. An analog phase shifter as claimed in claim 2, wherein $Z_0$ is less than 50Ω.

14. An analog phase shifter as claimed in claim 3, wherein $Z_0$ is substantially 30Ω.

15. An analog phase shifter as claimed in claim 7, wherein each of said terminating impedance circuit means further comprises compensating resistor means for compensating a variation of phase shifter insertion loss as said bias voltage is varied, so as to make said phase shifter insertion loss constant with respect to phase state.

16. An analog phase shifter as claimed in claim 8, wherein each of said terminating impedance circuit means further comprises compensating resistor means for compensating a variation of phase shifter insertion loss as said bias voltage is varied, so as to make said phase shifter insertion loss constant with respect to phase state.

17. An analog phase shifter comprising:

a first Lange coupler having an input port, an output port, first and second phase shifting ports, and a characteristic impedance $Z_0$;

a first pair of terminating impedance circuit means, connected respectively to said first and second phase shifting ports of said first Lange coupler, and each of said terminating impedance circuit means comprising in turn a pair of hyperabrupt varactor diodes, connected in parallel with a quarter-wavelength transmission line therebetween having a characteristic impedance of substantially 60Ω;

a second Lange coupler having an input port, an output port, first and second phase shifting ports, and a characteristic impedance $Z_0$, said input port of said second Lange coupler being connected to said output port of said first Lange coupler;

a second pair of terminating impedance circuit means, connected respectively to said first and second phase shifting ports of said second Lange coupler, and each of said terminating impedance circuit means comprising in turn a pair of hyperabrupt varactor diodes, connected in parallel with a quarter-wavelength transmission line having a characteristic impedance of substantially 60Ω;

a pair of impedance matching networks, connected respectively to said input port of said first Lange coupler and said output port of said second Lange coupler, for impedance matching with said first and second Lange couplers; and bias voltage means, connected to each of said terminal impedance circuit means, for applying a bias voltage thereto.

* * * * *